US005298884A

United States Patent [19]

Gilmore et al.

[11] Patent Number: 5,298,884

[45] Date of Patent: Mar. 29, 1994

[54] TAMPER DETECTION CIRCUIT AND METHOD FOR USE WITH WEARABLE TRANSMITTER TAG

[75] Inventors: Jack A. Gilmore, Longmont; Donald A. Melton, Boulder; Robert A. Null, Lakewood, all of Colo.

[73] Assignee: BI Incorporated, Boulder, Colo.

[21] Appl. No.: 962,483

[22] Filed: Oct. 16, 1992

[51] Int. Cl.[5] ..... G08B 19/00

[52] U.S. Cl. ..... 340/573; 340/572; 340/825.49; 340/825.54; 379/38

[58] Field of Search ..... 340/573, 572, 825.54, 340/825.49; 379/38

[56] References Cited

U.S. PATENT DOCUMENTS

| | | | |
|---|---|---|---|
| 3,478,344 | 11/1969 | Schwitzgebel et al. | 340/573 |
| 4,591,836 | 5/1986 | Feigenblatt et al. | 340/574 |
| 4,665,389 | 5/1987 | Clendening | 340/574 |
| 4,736,196 | 4/1988 | McMahon et al. | 340/573 |
| 4,812,823 | 3/1989 | Dickerson | 340/571 |
| 4,885,571 | 12/1989 | Pauley et al. | 340/573 |
| 4,918,432 | 4/1990 | Pauley et al. | 340/573 |
| 4,924,211 | 5/1990 | Davies | 340/573 |
| 4,952,913 | 8/1990 | Pauley et al. | 340/573 |
| 4,952,928 | 8/1990 | Carroll et al. | 340/513 |
| 5,117,222 | 5/1992 | McCurdy et al. | 340/573 |

OTHER PUBLICATIONS

Iversen, W. R., "High-Tech Leg Irons Put to the Test; Industrial Electronics,", *Electronics Week*, 58(9):30 (Mar. 4, 1985).

*Primary Examiner*—Glen R. Swann, III

*Attorney, Agent, or Firm*—Fitch, Even, Tabin & Flannery

[57] ABSTRACT

A wearable tag for use with an electronic house arrest monitoring (EHAM) system, or equivalent, is held against a limb of its wearer by a lockable strap. The tag includes tamper detection circuitry for detecting any attempt to remove the tag by cutting or breaking the strap, even when such cutting occurs in the presence of an electrolyte. The strap has a conductor imbedded therein that is in electrical contact, through known resistances, with respective terminals on the tag. The tamper detection circuit detects any change in the resistance of the strap. Further, the terminals are made of, or coated with, dissimilar metals, so that should the tag be immersed in an electrolyte, and the strap cut, the resulting galvanic action between the terminals allows the cut strap to be detected.

25 Claims, 9 Drawing Sheets

TAMPER DETECTION CIRCUIT AND METHOD FOR USE WITH WEARABLE TRANSMITTER TAG

BACKGROUND OF THE INVENTION

The present invention relates to detecting the unauthorized removal (tamper) of a wearable transmitter tag. More particularly, the present invention relates to a tamper detection circuit and method for detecting the unauthorized removal of a transmitter tag used in an electronic house arrest monitoring (EHAM) system, or equivalent system designed to monitor ambulatory objects or persons.

EHAM systems are known in the art. See, e.g., U.S. Pat. Nos. 4,885,571; 4,918,432 and 4,952,913, issued to Pauley et al., all of which are incorporated herein by reference. As indicated in those references, house arrest (a court-ordered mandate that requires a convicted law breaker to remain at a specific location, e.g., his or her house, at specified times) represents a very significant and viable alternative to conventional incarceration of convicted law breakers, especially those found guilty of non-violent crimes.

A typical EHAM system includes a transmitter tag that is securely attached to a limb of the person being monitored, and a field receiver that is mounted within the location whereat the offender is to remain. The transmitter tag periodically transmits an identifying signal that uniquely identifies its wearer. If the offender is within range of the field receiver, i.e., at the designated house arrest location, the field receiver receives and logs the identifying signal. If the offender is not within range of the field receiver, i.e., not at the designated house arrest location, the field receiver notes the absence of the identifying signal. Periodically or as needed, telecommunicative contact is established between the field receiver and a central monitoring computer so that the information received by the field receiver can be downloaded to the central computer.

While those sentenced to house arrest (hereafter the "offender") will generally recognize the need and benefit of complying with the sentence imposed, there nonetheless remains the need to monitor the presence or absence of the offender to ensure that the sentence imposed is being followed. Disadvantageously, the offender may sometimes attempt to foil the monitoring system by removing the transmitter tag. Hence, there is a further need in the house arrest monitoring art to detect any attempts by the offender to remove the transmitter tag, so that such events (hereafter "tamper events") can be promptly reported to the central monitoring computer.

One type of transmitter tag that has been used in EHAM systems of the prior art is essentially a two-piece molded structure inside of which the electronic circuits and batteries of the transmitter circuits are placed. Once the electronic circuits and batteries are placed inside of the unit, the two pieces of the case are permanently bonded or glued to each other, thereby creating a unitary construction. Unfortunately, such unitary sealed transmitter tag is useful only for the life of the battery, and then the tag must be discarded.

Another type of tag is disclosed in U.S. Pat. No. 4,812,823 issued to Dickerson, incorporated herein by reference. Dickerson teaches a tag case having a removable battery pack assembly that can be lockably secured to the tag case. As disclosed in Dickerson, an important feature of a portable tag used in personnel monitoring is that a strap that closes the tag around the wearer of the tag should be tamper resistant. One way of making such straps tamper resistant is to include a tamper detection circuit within the tag that detects an attempt to cut or otherwise violate the strap. Advantageously, such tamper detection circuit not only provides a means of notifying an operator at a remote location that the wearer has violated the strap, but also provides a substantial psychological deterrent to such violations. Dickerson teaches the use of a conductive material for the strap, thereby allowing anti-tamper electrical circuits within the tag to periodically perform electrical continuity checks to verify that the strap has not been cut.

Problematically, however, the Dickerson tamper detection means may be foiled by the wearer of the tag in at least two ways. First, the wearer may attach a parallel electric current path to opposite ends of the strap, e.g., by using a jumper cable having an alligator clip at both ends. Having attached the parallel electric current path to the strap, the strap can then be cut near the middle of the strap without breaking the electrical continuity of the anti-tamper electrical circuits. Thus, the wearer of the tag may easily defeat the Dickerson tag's anti-tamper circuits.

Second, if the Dickerson tag is immersed in an electrolyte solution and then the strap is cut, the electrolyte solution serves as a parallel electric current path to the strap. The strap can thus be cut without breaking the electrical continuity of the antitamper electrical circuits.

One possible way to detect tampering with the strap that cannot be easily foiled by using a parallel electric current path (a jumper) is through the use of a capacitance detector consisting of at least two electrodes. Such a capacitance detector is shown in U.S. Pat. No. 4,885,571, issued to Pauley et al., previously incorporated herein by reference. In '571 Pauley, a continuity check of a conductive strap or band that holds the tag on the wearer is combined with a capacitance detector. The capacitance detector comprises the strap or band (a first electrode) and a capacitor plate (a second electrode). A capacitance detection circuit is used to detect a change in the capacitance between the two electrodes. Normally, when the tag is worn, the strap wraps around a limb of the offender, e.g., around the offender's ankle. The capacitor plate, being housed within the tag case, is coupled to the strap via electrostatic coupling though the body mass around which the strap is closed. In the event the strap is cut after establishing a parallel electrical path using a jumper cable or equivalent, the capacitance detector detects a change in the capacitance between the two electrodes. The change in capacitance is due to the fact that the body mass around which the strap was closed is absent, thereby causing the electrostatic coupling to occur through a different medium, e.g., air, instead of through the body mass. Such different coupling causes the dielectric material of the capacitor to change; and, as a result, causes the capacitance of the capacitor to change. Thus, such detectable change in capacitance is used to indicate that the strap has been violated.

Problematically, however, the '571 Pauley tag can still be foiled by first immersing the tag in an electrolyte before cutting the strap. For example, saltwater, which is a good conductor and will serve as a parallel electrical path, has approximately the same dielectric characteristics, i.e., permittivity, as the body mass, i.e., flesh. Thus, by immersing the Pauley tag in an electrolyte, the anti-tamper circuits can be foiled.

What is thus needed is a way to detect violations of the strap of a wearable transmitter tag that cannot be foiled by either (1) creating an electric current path parallel to the strap before violating the strap; or (2) immersing the tag and strap in a suitable electrolyte before violating the strap.

The present invention advantageously addresses the above and other needs.

SUMMARY OF THE INVENTION

The present invention advantageously provides a tamper circuit and method for detecting a tamper event associated with the use of a wearable transmitter tag of the type used within an electronic house arrest monitoring (EHAM) system. Advantageously, the tamper circuit is included within the wearable transmitter tag. The wearable transmitter tag, as with transmitter tags of the prior art, includes: (1) a transmitter or other means for transmitting an identification signal; (2) a strap detachably coupled to the transmitter tag; and (3) means for lockably securing the tag around a limb of an offender with the strap. Unlike transmitter tags of the prior art, however, the tamper circuit of the present invention detects any attempt to cut the strap, and any attempt to create a parallel electrical path that bypasses the strap, including such attempts when the tag and strap are immersed in an electrolyte solution.

The strap is coupled to the transmitter tag and locked around the limb of the offender using a locking mechanism that is substantially the same as is disclosed in the Dickerson patent, previously incorporated herein by reference. Basically, such locking mechanism is implemented using rails that are selectively attached to the strap at a desired length. The rails are then slideably inserted into open ends of respective keyed channels along each side of the wearable tag. A locking wedge comprising a male part and a female part is then slideably inserted and locked onto a second rail along the top of the wearable tag, which second rail intersects the keyed channels into which the strap rails are inserted, thereby blocking removal of the strap rails.

Alternatively, any suitable means of coupling the strap to the tag may be used, such as rivets, screws, or one or more molded plastic strap loops. Also, any suitable means may be used to lock or secure the strap into a closeable, locked loop so that the closeable loop can be closed around a limb of the offender, such as, e.g., a buckle, a clasp, a clip, a hook, a snap, a button, a screw, a rivet, or any other means of closing the strap around the wearer.

In accordance with one aspect of the invention, the strap includes a hidden conductor that is longitudinally imbedded therein. When the strap is coupled to the transmitter tag, it is coupled in such a way that a finite resistance is inserted in series with the imbedded hidden conductor. The tamper circuit includes a resistance monitoring circuit that monitors the total resistance present in the strap, including the resistance added by the coupling process. Any attempt to cut or break the strap is immediately detected as an open circuit. Further, any attempt to bypass the strap is detectable as a changed resistance.

The coupling of the strap to the transmitter tag is achieved, in a preferred embodiment, by forming the strap from a material having a relatively low conductivity (high resistance) and by imbedding the hidden conductor (which has a high conductivity, or low resistance) within such strap material. The transmitter tag includes a conductive button at each location where the strap is to be attached to the tag. Such buttons are in electrical contact with the resistance monitoring circuits of the tamper circuit. When the straps are detachably coupled to the tag, the buttons make physical contact with the strap material, but not with the imbedded conductor. Electrical contact with the imbedded conductor is thus achieved through the strap material, which material has a known resistance associated therewith. The total resistance of the strap therefore includes the resistance of the strap material in a region between the conductive buttons and the imbedded conductor, plus the resistance of the imbedded conductor.

In accordance with another aspect of the invention, the tamper circuit further includes a galvanic action detector. Such galvanic detector is used to detect if the strap is cut while the tag and strap are immersed in an electrolyte solution, such as salt water. Such galvanic detection is made possible by incorporating electrodes made from dissimilar metals on opposite sides of the tag or at opposite ends of a conductive strap that is coupled to the tag. When the closed strap and tag are immersed in an electrolyte solution, galvanic action results between the dissimilar electrodes, causing a detectable current to flow between the dissimilar electrodes through the conductive strap. If the conductive strap is cut, the charged particles associated with the galvanic action build up on the electrodes, causing a detectable galvanic voltage to be present. The conductive strap may comprise the strap itself (e.g., a strap made from conductive material), or may comprise one or more wires or ribbons imbedded into or onto the strap.

In accordance with yet a further aspect of the invention, the resistance monitoring circuit and the galvanic action detector may be realized using the same circuitry, e.g., a single operational amplifier that compares the voltage developed across the strap to a reference voltage when the total strap resistance is included in a resistive divider network. If the strap voltage suddenly increases above the reference voltage to a maximum level, that indicates the strap has been cut. If the strap voltage suddenly increases above the reference voltage without reaching a maximum level, that indicates galvanic action is present. In either event, a rising of the strap voltage above the reference voltage indicates a tamper condition. In some embodiments, a similar comparator circuit may be used to detect if the strap voltage suddenly decreases to near zero. If so, that indicates the strap has been shorted by a parallel electrical path, e.g., a jumper wire.

It is thus a feature of the invention to provide a tamper circuit for use with an EHAM or similar system that detects a change in the resistance of a strap used to secure a transmitter tag to an offender, thereby providing a means of detecting any attempts to remove the tag by tampering with the strap.

It is a further feature of the invention to provide a transmitter tag assembly for use with an EHAM or similar system that allows tamper events to be readily detected, yet is simple to manufacture, and easy to install (attach to an offender).

It is yet an additional feature of the invention to provide a tamper circuit for use with an EHAM or similar system that allows a plurality of tamper events to be monitored, and that reports a tamper condition only when a prescribed one or combination of such monitored tamper events occurs.

It is another feature of the invention to provide a tamper circuit for use with an EHAM or similar system that also detects when the strap is severed while the transmitter tag and strap are immersed in an electrolyte solution, such as salt water.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
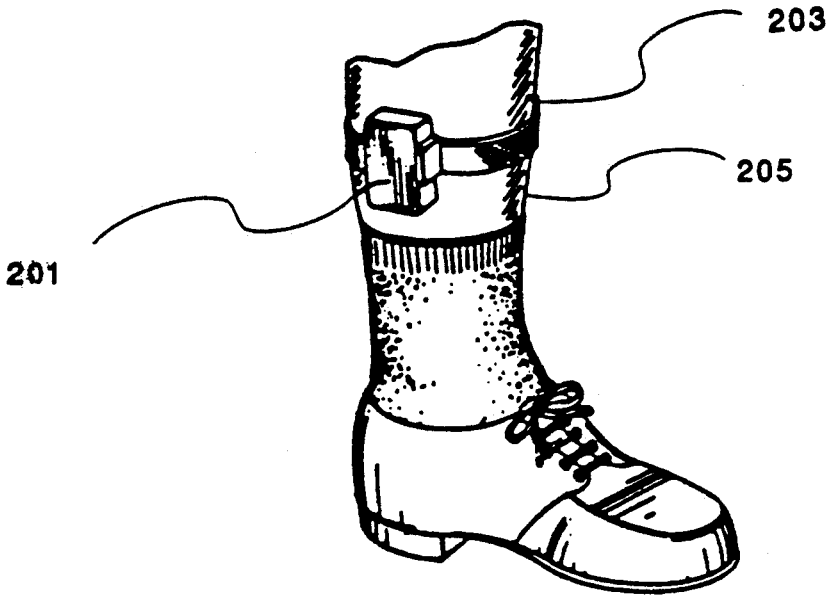
FIG. 1 illustrates one manner in which a tag is secured around a limb of its wearer by a strap.

A preferred application for the present invention is within a transmitter tag used as part of an electronic house arrest monitoring (EHAM), or other personnel monitoring, system. In such a system, as seen in FIG. 1, a transmitter tag 201 is typically fastened to an ankle 205, or other limb, of a person who is to be monitored. See FIG. 1. The electronic circuits within the tag 201 perform two main functions: (1) they transmit a unique identification signal that is received and processed by one or more remote receivers, thereby allowing the location of the person wearing the tag to be monitored; and (2) they sense the occurrence of a tamper event, such as an attempt to remove the tag 201 from the ankle 205 of its wearer, and signal the remote receiver of such an occurrence. While the electronic circuits within the tag 201 are important for the proper operation and use of such a personnel monitoring system, it is noted that the present invention is directed primarily to circuits and methods for detecting a tamper event associated with the use of the tag 201. For purposes herein, a "tamper event" is any unauthorized event aimed at interfering with or disrupting the operation of the operation of the tag 201. Tamper events may include, e.g., cutting or breaking a strap 203 that secures the tag 201 to its wearer; cutting the strap while immersing the tag 201 in an electrolyte solution; and the like. Details of the electronic circuits used to perform and report a tamper detection are not presented herein, except to the extent necessary to understand the tamper detection features of the invention. For those interested in such details, reference should be made, e.g., to U.S. Pat. Nos. 4,885,571 and 4,952,913, previously incorporated by reference.

Referring to FIG. 1, a tag 201 is shown with a strap 203 wrapped (closed) around a limb, e.g., ankle, of its wearer 205. The wearer 205, in accordance with the EHAM system application of the present invention, is typically an offender who has been convicted of violating some law, or is under a condition of parole. In any event, the offender is typically required to remain at a specified location, at least during certain hours of the day.

In order to facilitate the manufacture, in the first instance, and the sizing and installation (fitting) of the strap on the offender, in the second instance, the strap 203 is detachably connected to the tag 201 utilizing a suitable coupling mechanism, or coupler. This allows the strap 203 to be manufactured as a separate item, and carried to the field as a separate one-size-fits-all item. However, once in the field, the strap can be cut to whatever size is needed to fit the particular offender on whom the tag is to be worn. Thereafter, the strap may be detachably secured to the tag, just as though the tag and strap were of a unitary construction. In addition, in order to prevent the offender from removing the tag once it has been installed, the strap is locked or closed around the limb of the offender using a locking or closing means. A preferred coupler and closing means is explained more fully below in connection with FIGS. 7–9.

Figure 2:
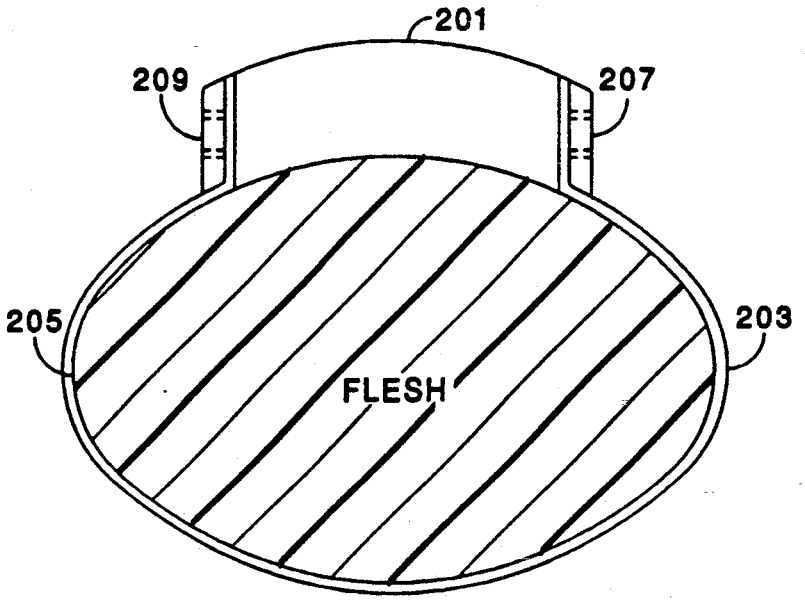
FIG. 2 is a cross sectional view of the tag as it is secured around the limb of its wearer by the strap.

Referring next to FIG. 2, a cross sectional view of the tag 201 is shown closed around the limb 205 of the offender using the strap 203. FIG. 2 further illustrates that the strap 203 connects to the tag 201 using a coupler that includes two halves 207 and 209. Each half is lockably connected to an opposing side of the tag 201, as explained more fully below in conjunction with FIGS. 7–9.

Figure 3:
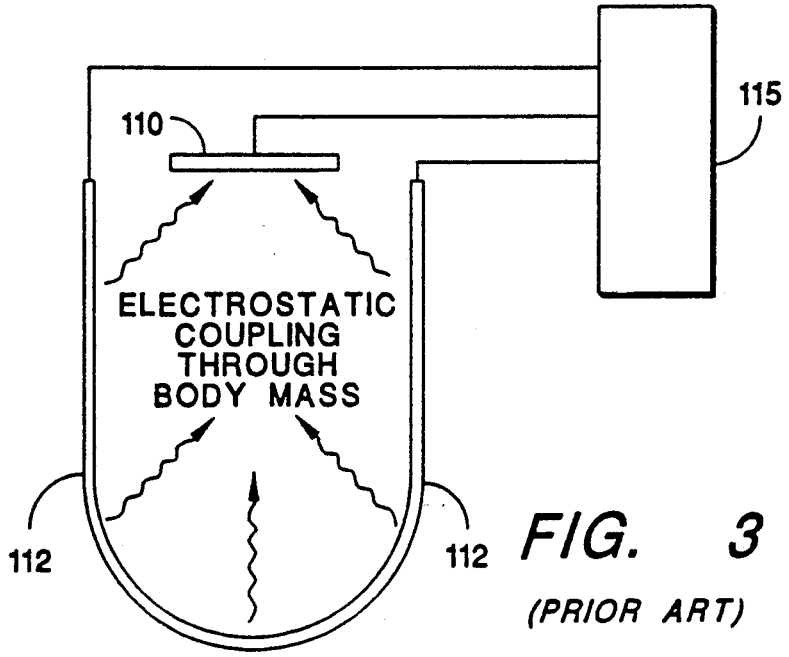
FIG. 3 (PRIOR ART)
FIG. 3 is a schematic block diagram of a prior art capacitance detector used to detect a tamper condition, e.g., an attempt to remove the tag so that it is no longer held against the flesh of its wearer.

Shown in FIG. 3 is a schematic block diagram of a prior art capacitance sensitive tamper detector useable in combination with the present invention. The capacitance sensitive tamper detector has a central electrode 110 and a strap electrode 112 comprising a conductor. A capacitance detector 115 is also shown that detects a change in the capacitance between the electrodes 110 and 112. In one embodiment of this type of tamper detector, the strap electrode 112 comprises a strap made from electrically conductive material, e.g., flexible metal. Alternatively, in the present invention, the strap electrode 112 may, e.g, be made from one or more wire strands implanted into the strap or laminated onto the strap. Such implanted or laminated wire strands are not shown in the prior art. The central electrode 110 is positioned within the tag case such that it is not readily accessible. When an alternating current signal is applied to the strap electrode 112, an alternating electric field emanates from the strap electrode 112 as indicated by wavy arrows in FIG. 3. The electric field thus established interacts with the electrons in the central electrode 110 to cause a current flow in the central electrode.

As indicated above, the type of capacitance sensitive tamper detector shown in FIG. 3 is known in the art. See U.S. Pat. No. 4,885,571, previously incorporated by reference herein. Advantageously, in accordance with the present invention, such capacitance sensitive tamper detector may be used in conjunction with the other tamper detection circuits described herein.

Figure 4:
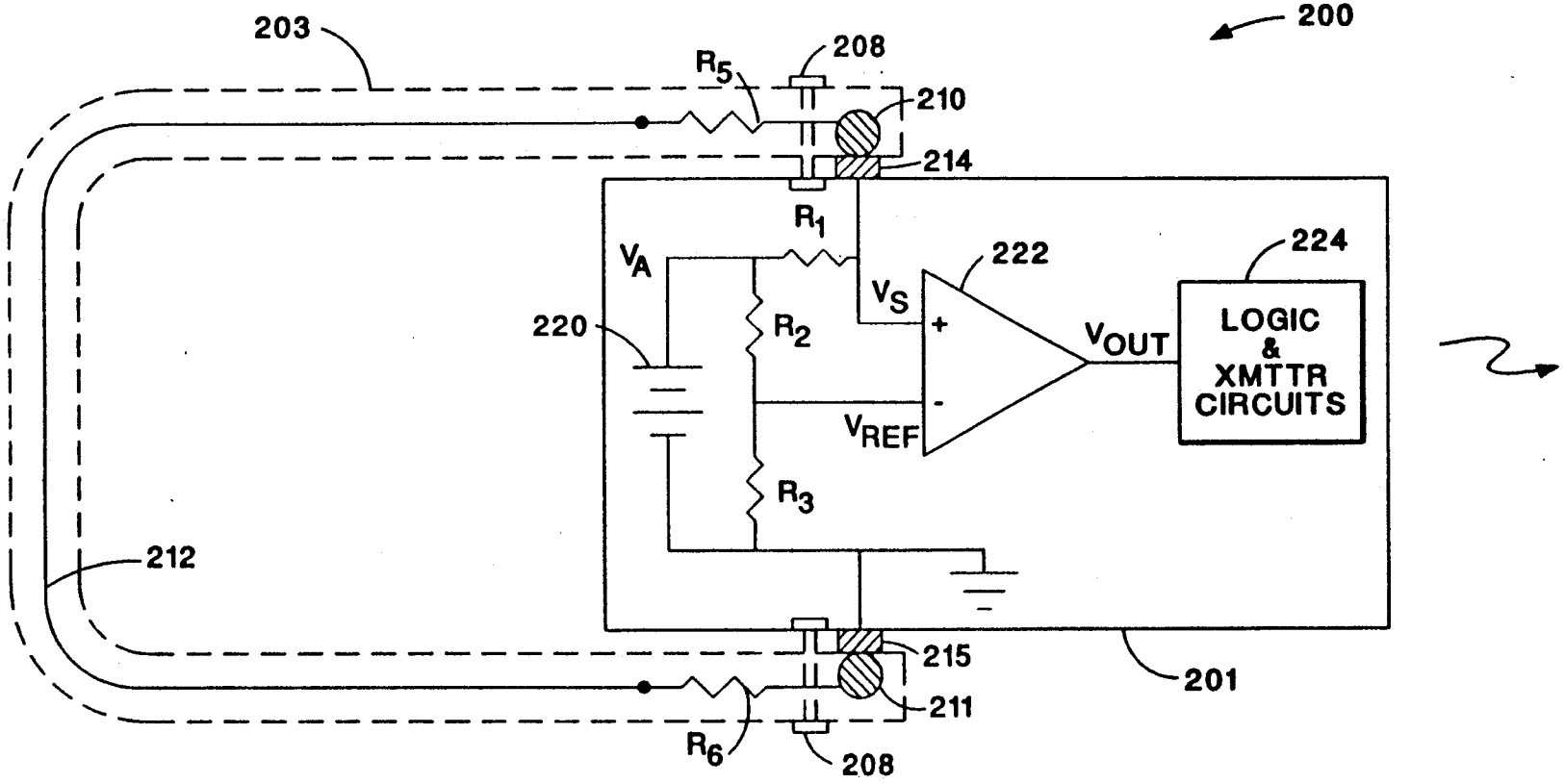
FIG. 4 is a block schematic diagram of a transmitter tag having a tamper circuit incorporated therein in accordance with the present invention.

Turning next to FIG. 4, there is shown a block schematic diagram of a transmitter tag assembly 200 made in accordance with the present invention. The assembly 200 includes the transmitter tag 201 and the strap 203. The strap 203 is detachably connected to opposite sides of the tag 203 using a suitable coupler or connecting means 208. Schematically, the coupler 208 is shown in FIG. 4 as a pin or rivet that securely holds the ends of the strap 208 against the sides of the tag 201. While a pin or rivet may certainly serve this connecting function, it is to be understood that the invention is not so limited. A preferred coupling and locking mechanism is described below in conjunction with FIGS. 7-9.

Imbedded or laminated within the strap 203 is a conductor 212. The conductor 212 may be a single strand of small gauge copper or aluminum wire, e.g., 30 AWG, or a flexible band or ribbon of, e.g., copper, silver, or other suitable electrically conductive material, having a high conductivity. The conductor 212 is connected at each end of the strap 203 to a conductive terminal or button through a resistance. That is, a conductive button 210 at one end of the strap 203 is connected through a resistance $R_5$ to the conductor 212. A conductive button 211 at the other end of the strap 203 is connected through a resistance $R_6$ to the conductor 212. Both $R_5$ and $R_6$ are selected to have resistance values that are significantly greater than the resistance of the conductor 212. For example, assuming a strap length of about 6 to 8 inches, the overall resistance of the conductor 212 imbedded within the strap 203 is much less than an ohm. The resistance values $R_5$ and $R_6$, on the other hand, would be selected to be much greater than 1 ohm, e.g., 75 ohms each, so that the total resistance of the strap as measured from the conductive button 210 to the conductive button 211 would be, for all practical purposes, determined by the values of $R_5$ and $R_6$.

Still referring to FIG. 4, when the strap 203 is connected to the tap 201, it is connected such that the conductive buttons 210 and 211 make physical and electrical contact with corresponding terminals 214 and 215 on the side of the tag 201. These terminals 214 and 215, in turn, are connected to the tamper detection circuitry housed within the tag 201.

In order to detect the immersion of the transmitter tag assembly in an electrolyte solution, the tag terminal 214 is made or coated with a dissimilar metal than is the tag terminal 215. Alternatively, the strap buttons 210 and 211 may be made from, or coated with, dissimilar metals. For example, the terminal 215 and button 211 may be coated with conventional solder, while the terminal 214 and button 210 are not coated with solder. Thus, when the tag assembly 200 is immersed in an electrolyte solution, such as salt water, the dissimilar metals act like a small cell, and a voltage difference, referred to as the galvanic voltage, $V_G$, is developed between the dissimilar metals.

The tamper detection circuitry functionally includes a battery 220, a comparator circuit 222, and resistors $R_1$, $R_2$ and $R_3$. The resistors $R_2$ and $R_3$ are connected in series across the battery 220 to form a resistive dividing network. The voltage developed across $R_3$ is thus a fraction of the battery voltage $V_A$ as determined by the ratio $R_3/(R_2+R_3)$. This voltage, shown in FIG. 4 as the reference voltage $V_{REF}$, is applied to the negative input of the operational amplifier/comparitor 222.

The resistor $R_1$ is connected between the positive side of the battery, i.e., the voltage $V_A$, and the tag terminal 214. The tag terminal 215 is connected to the other side of the battery, i.e, ground. The resistor $R_1$ is thus connected in series with the strap resistance ($\approx R_5+R_6$) to form another voltage dividing network. The voltage developed across the strap 203, i.e., the voltage present between the terminal 214 and ground, is thus a fraction of the battery voltage $V_A$ as determined approximately by the ratio $(R_5+R_6)/(R,+R_5+R_6)$. This voltage, shown in FIG. 4 as the strap voltage, $V_S$, is applied to the positive terminal of the operational amplifier/comparitor 222.

The output of the operational amplifier/comparitor 222, $V_{OUT}$, is connected to the logic and transmitter circuits 224 of the tag 201, which circuits may be of conventional design.

Figure 5A:
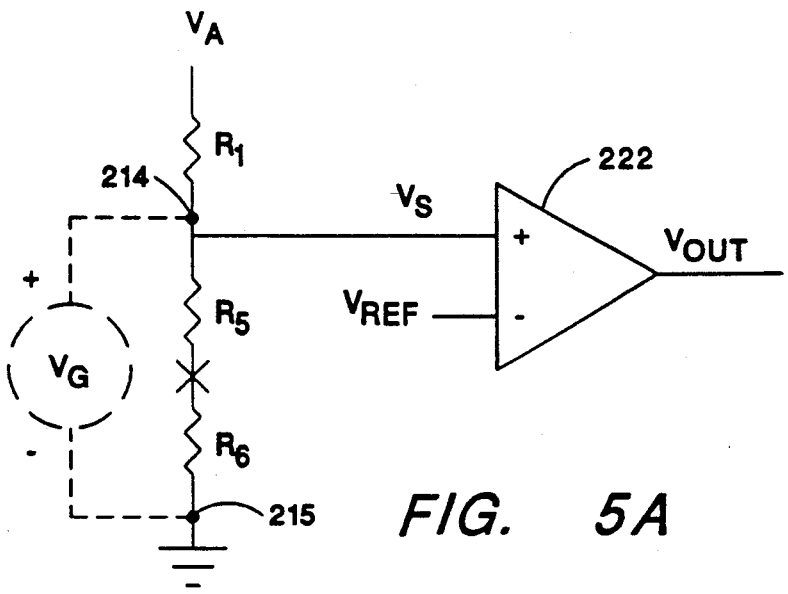
FIGS. 5A and 5B illustrate the resistance and galvanic monitoring functions carried out by a tamper circuit made in accordance with the present invention.
Figure 5B:
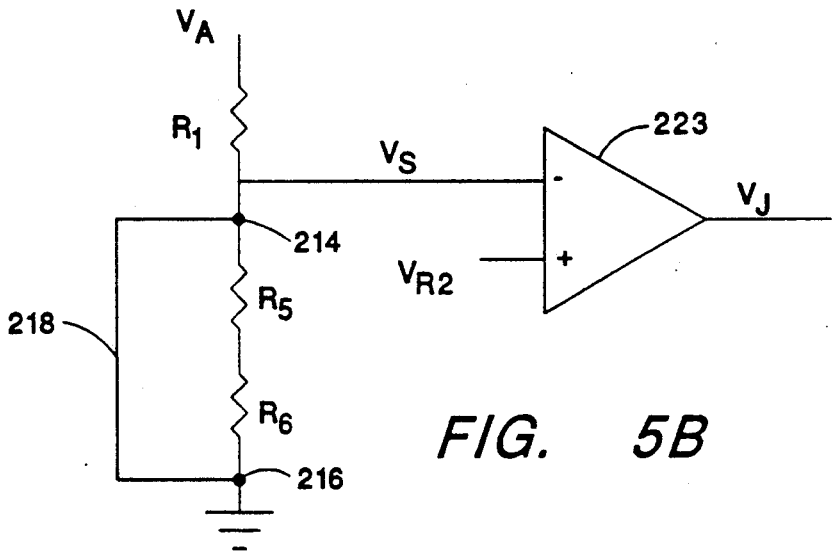
Figure 5C:
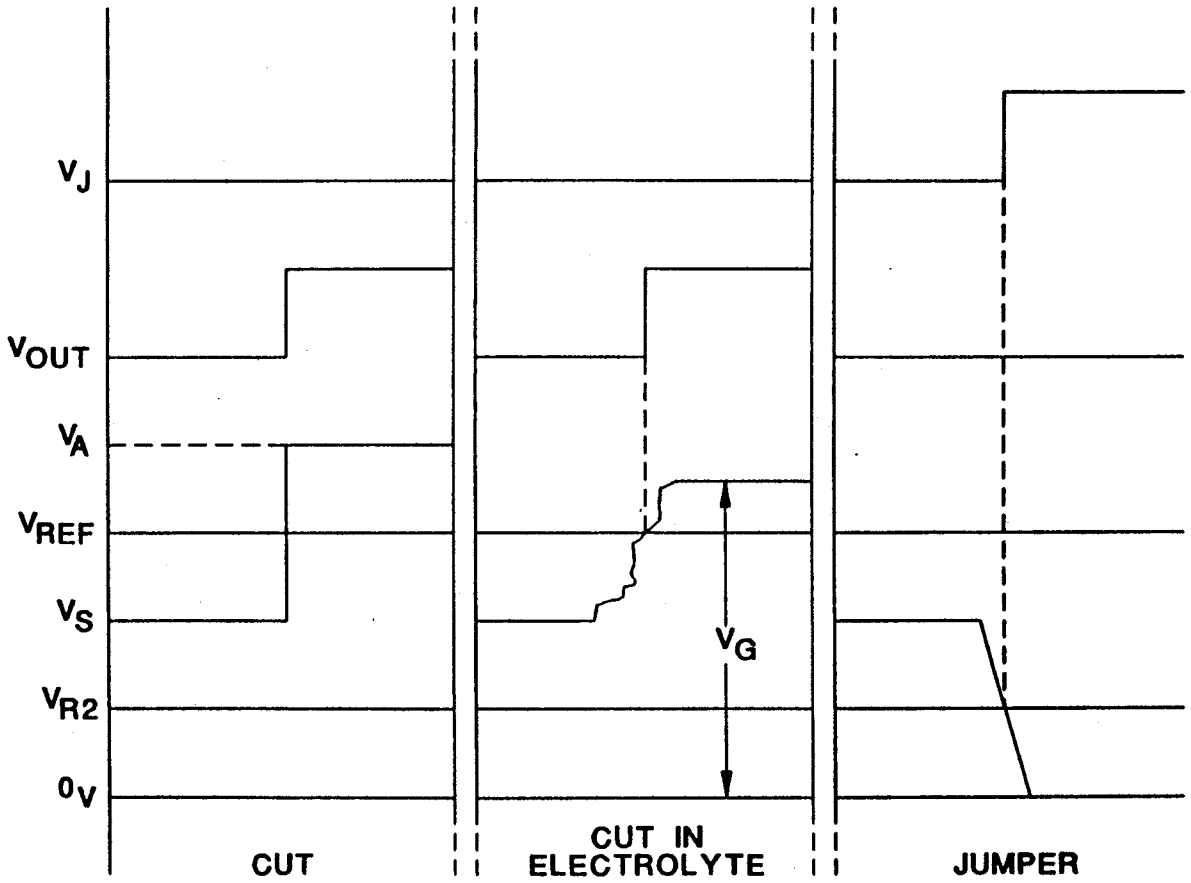
FIG. 5C illustrates the operation of the circuits of FIGS. 5A and 5B.

The operation of the tamper portion of the transmitter tag assembly is best understood with reference to FIGS. 5A-5C. The value of the reference voltage $V_{REF}$ is selected to be greater than the value of $V_S$, but less than the battery voltage $V_A$, when the strap 203 is connected to the tag 201 in conventional manner. For example, if $V_A$ is 3.5 volts, the value of $V_{REF}$ may be selected to be approximately 1.7 volts by making $R_2$ equal to $R_3$. The value of $R_1$ is then selected in combination with the known values of $R_5$ and $R_6$ so that the strap voltage $V_S$ is somewhat less than 1.7 volts, e.g, 1.5 volts. Thus, during normal operation, as shown at the extreme left of FIG. 5C (which FIG. 5C shows a timing waveform diagram that illustrates the relationship between the signals or voltages $V_S$, $V_{REF}$, $V_A$ and $V_{OUT}$ as a function of time) the output voltage of the amplifier/comparitor 222, $V_{OUT}$, is low because the input voltage applied to the positive input terminal, $V_S$, is less than the input voltage applied to the negative input terminal, $V_{REF}$. However, as soon as the strap 203 is cut or broken, causing the strap to appear as an open circuit (effectively causing $R_5+R_6 \approx \infty$), the strap voltage $V_S$ is pulled up to $V_A$, causing the output voltage of the amplifier/comparitor 222, $V_{OUT}$, to go high.

Should the transmitter tag assembly 200 be immersed in an electrolyte solution, then a galvanic voltage $V_G$ is developed across the terminals 214 and 215. Such galvanic voltage causes a return current to flow through the strap 203, i.e., through the conductor 212 and the resistors $R_5$ and $R_6$. So long as the strap remains intact, this galvanic voltage is of little consequence. However, if the strap is cut while in the electrolyte solution, the galvanic action causes an increase in the voltage across the strap $V_S$ to an amount $V_G$, as shown in the center portion of FIG. 5C. Such action causes the input voltage applied to the positive terminal of the amplifier/comparitor 222 to switch from a value that is lower than the reference voltage $V_{REF}$ to a value that is higher than the reference voltage $V_{REF}$, thereby causing the output voltage $V_{OUT}$ of the amplifier/comparitor 222 to again switch from a low value to a high value. Note that it is important to select $V_{REF}$ such that a change in the voltage across the strap $V_S$ to the amount $V_G$ causes the voltage accross the strap $V_S$ to become larger than $V_{REF}$, i.e., $V_{REF}$ must be less than $V_G$. In this manner, then, either the cutting (or breaking) of the strap 203, or the cutting of the strap while immersed in an electrolyte solution, causes the output voltage of the amplifier/comparitor 222 to switch from a low value to a high value, thereby signaling a tamper event.

Those of skill in the art will recognize that the use of the operational amplifier/comparitor 222 in the manner described above is to use the amplifier/comparitor as a threshold detector, detecting whenever the input voltage is less than or greater than a reference voltage. That is, the amplifier/comparitor 222 detects whenever the current flow through the strap is interrupted, which action causes the voltage across the strap to increase. Such detection advantageously occurs whenever the strap is cut or broken, whether in an electrolyte solution or not.

The invention further contemplates that the tamper circuitry housed within the tag 201 may further detect when the strap resistance decreases, e.g., when an attempt is made to place a jumper wire 218 in parallel with the strap as shown in FIG. 5B. One technique for detecting a decrease in strap resistance is to include an additional amplifier/comparitor 223, or equivalent threshold detector circuit, that detects when the strap voltage $V_S$ drops below a reference voltage $V_{R2}$. The reference voltage $VR_2$ is selected to be less than the normal strap voltage. For example, if the normal strap voltage is 1.5 volts, the reference voltage $V_{R2}$ may be selected to be 1.3 volts. This reference voltage $VR_2$ is then applied to the positive input terminal of the additional amplifier/comparitor 223. The strap voltage, $V_S$, is then connected to the negative input terminal of the amplifier/comparitor 223. Should a jumper 218 be connected across the strap, effectively causing the strap resistance to go to zero, then, as seen in the right side of FIG. 5C, the strap voltage likewise goes to zero, causing the output voltage of the amplifier/comparitor 223, $V_J$, to switch from a low voltage to a high voltage.

Thus, as described above, it is seen that the tamper circuit of the tag assembly is able to detect an increase in the effective strap resistance, as when the strap is cut whether or not immersed in an electrolyte; as well as a decrease in the strap resistance, as when a jumper is connected in parallel with the strap.

Figure 10A:
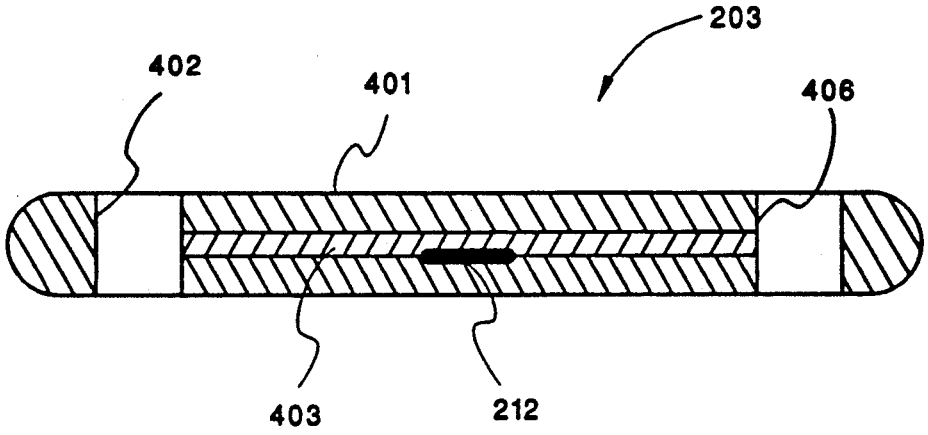
FIG. 10A is a cross sectional view of one embodiment of a strap made in accordance with the present invention.
Figure 10B:
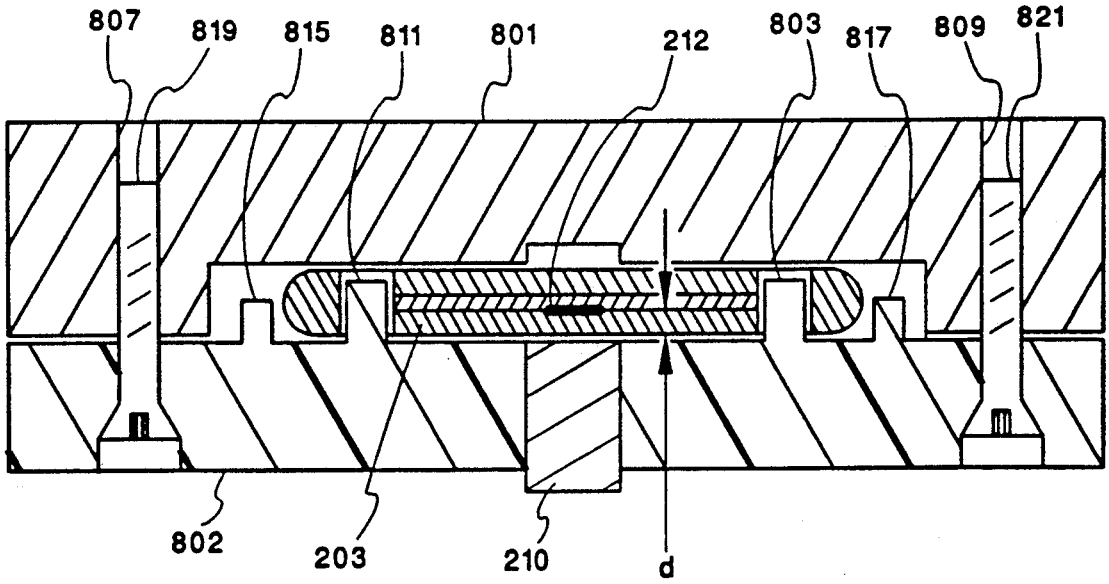
FIG. 10B is a cross sectional view as in FIG. 10A and further includes the rail assembly of FIG. 9.

Note, however, that if the preferred strap 203 (FIG. 10B) is used, it is very difficult or impossible to use a jumper wire to foil the tamper circuitry even without any means of detecting a decrease in the strap resistance as described above. This is because in the event that a jumper wire with an allegator clip at both ends is attached to opposite ends of the strap, the allegator clips will be in electrical contact with the conductive strap 401 (FIG. 10B), not the conductor 212 (FIG. 10B). When the strap is cut with the jumper thus attached to the strap, the resistance between the terminals 214 and 216 increases significantly because the current must pass through the conductive strap to reach the allegator clips before being conducted through the jumper wire, i.e., two additional resistances (in addition to $R_5$ and $R_6$) are introduced into the current path between terminals 214 and 216. Advantageously, an attempt to use a jumper wire to foil the tamper circuitry will probably fail even without any means of detecting a decrease in the strap resistance.

Figure 6:
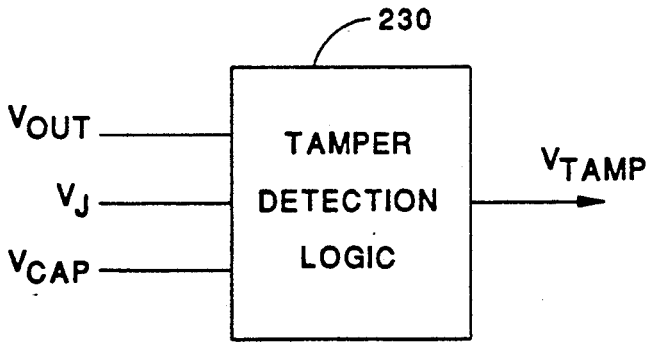
FIG. 6 is a block diagram of tamper detection logic that may be incorporated as part of the present invention.

Typically, the logic circuits of the tag 201 will include appropriate tamper detection logic 230 as shown in the block diagram of FIG. 6. The tamper detection logic 230 allows a plurality of tamper conditions to be monitored. For example, as shown in FIG. 6, the inputs to the tamper detection logic include three signals: (1) $V_{OUT}$ as obtained, e.g, from the amplifier/comparitor 222, and used to indicate a cutting of the strap, regardless of whether the strap is in an electrolyte; (2) $V_J$ as obtained, e.g., from the amplifier/comparitor 223, and used to indicate the connecting of a jumper in parallel with the strap; and (3) $V_{CAP}$ as obtained, e.g., from a capacitance detector 115 (FIG. 3), and as described in the '571 patent of Pauley et al.

Some embodiments of the invention may include sufficient sophistication in the telemetry circuits within the tag 201 to allow the type of tamper condition sensed to be included in the identification signal 232 that is transmitted from the tag. For example, in such embodiments, a two bit code may be included in the transmitted identification signal that identifies the type of tamper detected. A "00" code, for example, may signify that the $V_{OUT}$ signal has gone high; while a "01" code may signify that the $V_J$ signal has gone high; and a "11" code may indicate that the $V_{CAP}$ signal is present, indicating that the offender's body flesh is not detected as being present.

Other embodiments of the invention, however, maintain the tag circuits as simple as possible, including the tag telemetry circuits. In such embodiment, any tamper event that occurs of the plurality of possible tamper events that are monitored is simply signaled as a tamper event, $V_{TAMP}$. In such instance, the inputs to the tamper detection logic 230 are analyzed in accordance with a prescribed truth table. A simple truth table, for example, may map the occurrence of any monitored tamper event as a tamper event signal, $V_{TAMP}$. If so, the tamper detection logic 230 may be realized simply by using a three-input OR gate, with each of the tamper event signals $V_{OUT}$, $V_J$ and $V_{CAP}$ comprising one of the inputs, and with the output being the $V_{TAMP}$ signal.

However, it is to be emphasized that the monitored events need not be weighted equally. For example, one possible truth table is shown below in Table 1.

TABLE 1

Truth Table for Tamper Detection Logic

| $V_{OUT}$ | $V_J$ | $V_{CAP}$ | $V_{TAMP}$ |
|---|---|---|---|
| 0 | 0 | 0 | 0 |
| 0 | 0 | 1 | 0 |
| 0 | 1 | 0 | 1 |
| 0 | 1 | 1 | 1 |
| 1 | 0 | 0 | 1 |
| 1 | 0 | 1 | 1 |
| 1 | 1 | 0 | 1 |
| 1 | 1 | 1 | 1 |

As seen for the example shown in Table 1, not all of the monitored tamper events are weighted equally. For example, detecting that the capacitance has changed, as indicated by the presence of the $V_{CAP}$ signal, aces not, by itself, signal a tamper event. Rather, it takes the combination of both a $V_{CAP}$ signal, plus either a $V_{OUT}$ detection and/or a $V_J$ detection to cause a $V_{TAMP}$ signal to occur. However, the occurrence of either a $V_{OUT}$ signal or a $V_J$ signal by themselves does signal a tamper event.

It is to be emphasized that the truth table shown in Table 1 is only exemplary; and that the invention is not limited to the particular combinations of tamper events shown therein.

Figure 7:
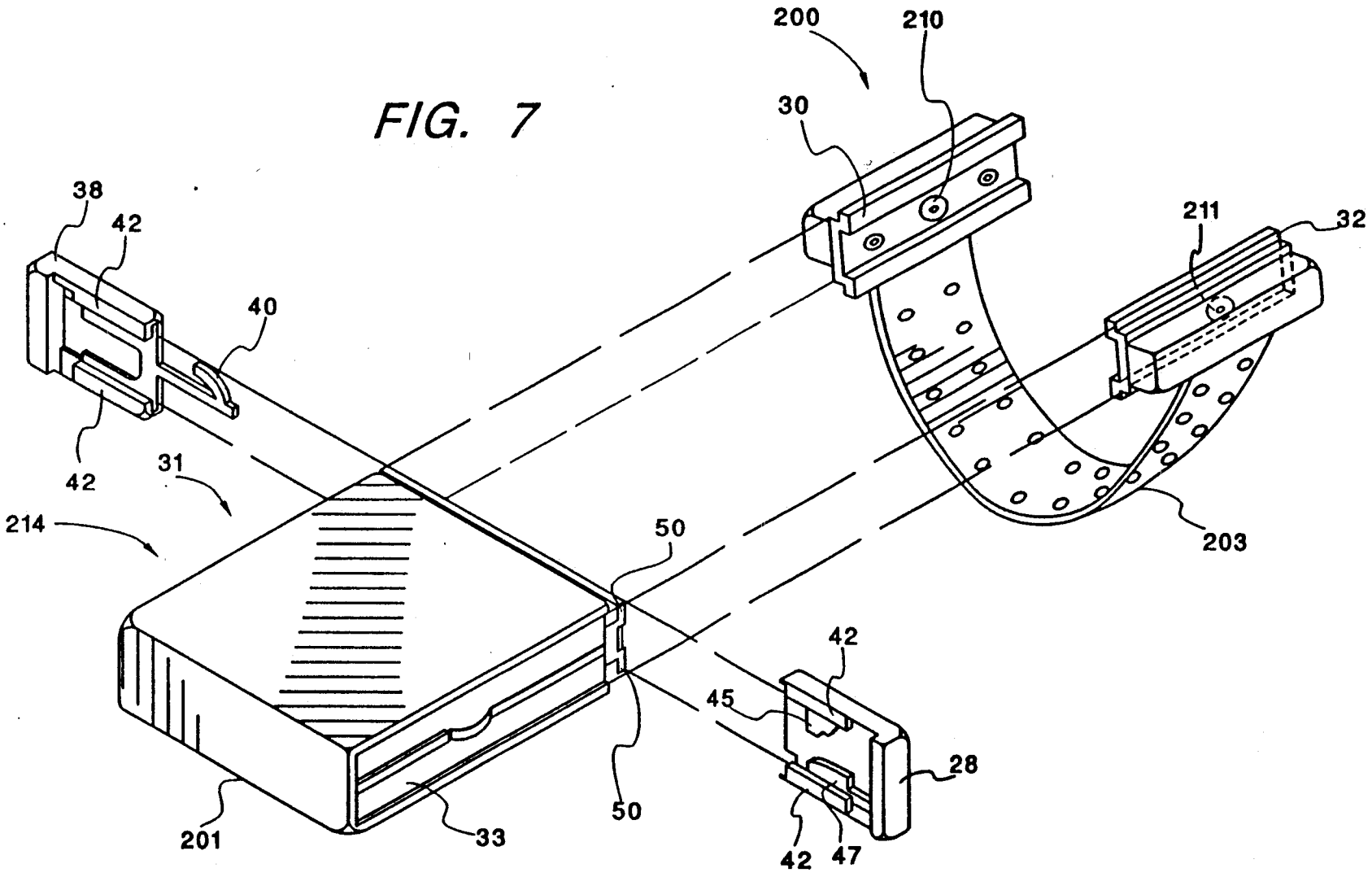
FIG. 7 is an exploded perspective view of a tag and strap made in accordance with the present invention.

Referring next to FIG. 7, an exploded view of a preferred embodiment of the transmitter tag assembly 200 of the present invention is shown. The main components of the transmitter tag assembly 200 include the transmitter tag 201, a conductive strap 203 having respective rail assemblies 30 and 32 attached to the ends thereof, a male locking wedge 38, and a female locking wedge 28. The electronic circuits and components of the tamper detection system are housed within the tag 201 or are included within the strap or rail assemblies.

The rail assemblies 30 and 32 are attached to the ends of the strap 203. Rail assembly 30 is designed to slide into receiving channel 31 (not visible in FIG. 7) along what is the far or back side of the tag 201 as the tag 201 is positioned in FIG. 7. Similarly, rail assembly 32 is designed to slide into receiving channel 33 along the near or front side of the tag 201 as such tag 201 is positioned in FIG. 7. As explained below, the rail assemblies 30 and 32 are secured to the strap 203 using screws, the heads of which are not accessible for tampering once the rail assemblies 30 and 32 are installed. A more detailed description of how the rail assemblies are secured to the strap 203 is given below in conjunction with FIG. 9.

Once the rail assemblies 30 and 32 have been inserted into their respective channels 31 and 33, the male locking wedge 38 and the female locking wedge 28 are slidably inserted onto opposite ends of a receiving rail 50 that protrudes along what appears as the top or right side of the tag assembly 201 as the tag 201 is positioned in FIG. 7. Once such wedges 26 and 28 are lockably inserted into the rail 50, the rail assemblies 30 and 32 are locked into their respective channels, and cannot be removed.

The manner in which the male wedge 38 locks into the female wedge 28 will now be explained. As the male wedge 38 and the female wedge 28 are slid farther onto the receiving rail 50, a protruding tip 40 of the male wedge 38 is received between a locking structure 45 and a compression structure 47 of the female wedge 28. A sloped engaging rib or ridge on the locking structure 45 within the female wedge 28 allow the male tip 40 to be inserted between the locking structure 45 and the compression structure 47 by compressing or squeezing together end portions of the male tip 40 as such end portions slide over the rib or ridge. These end portions are stiff, but not rigid to the point where they won't bend. However, they are resilient so that if compressed or pushed they return to their normal position. Thus, once the end portions pass over the engaging rib, these end portions cannot pass over the straight back side of the rib, and the male tip 40 is forever thereafter locked within the female locking wedge 28. Therefore, by slidably inserting the male wedge 26 and the female wedge 28 fully onto the rail 50, which full insertion causes the ends of the male tip 40 to pass over the ridge of the locking structure 45 within the female locking wedge 28, the male and female wedges 38 and 28 become firmly and securely locked together. The only way the locking wedges 38 and 28 may be removed from the rail 50 once they have been locked together is by cutting off the protruding tip 40 of the male locking wedge 38.

Figure 8:
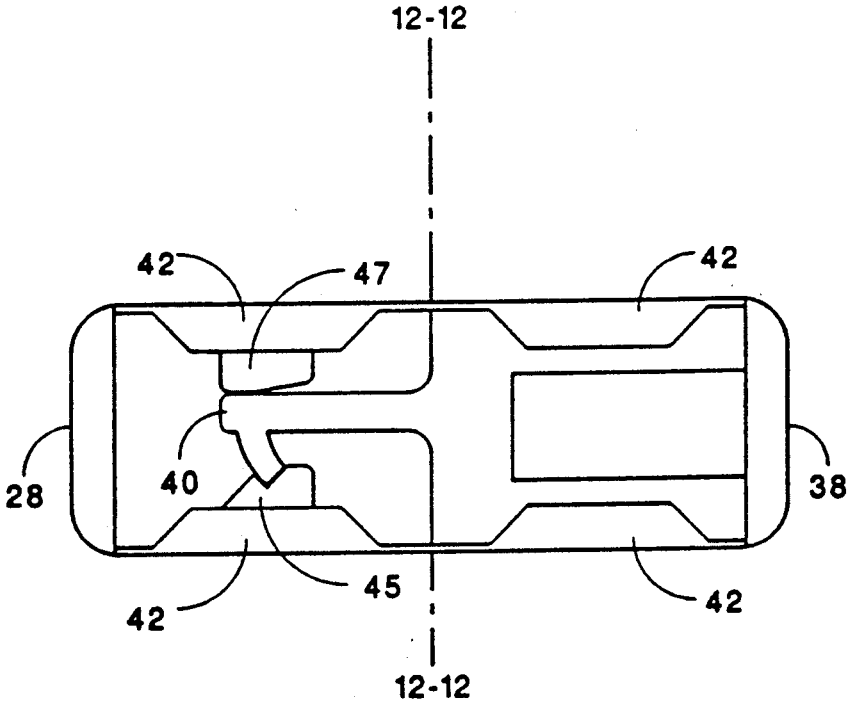
FIG. 8 shows a male wedge piece interlocked with a female wedge piece for use with the tag and strap of FIG. 7.

A bottom view (as seen looking from the protruding rail 50 of the tag 201) of the male locking wedge 38 locked to the female locking wedge 28 is shown in FIG. 8. The tag case 201 is not shown in FIG. 8 so that the male locking wedge 38 can be seen locked into the female locking wedge 28. A sliding channel is formed in the tagside of the locking wedges 28 and 38 by four teeth 42. The teeth 42 slide over rail 50 (FIG. 7) to secure the locking wedges 38 and 28 to the tag 201. As the wedges are slid over the rail from antithetical ends of the rail 50 (FIG. 7), the tip 40 of the male wedge 38 enters a locking channel between the compression structure 47 and the locking structure 45. As the tip 40 enters further into the channel, the tip 40 of the male wedge 38 passes over the teeth of the locking structure 45 until the tip 40 snaps securely into place as shown in FIG. 8. When the wedges 28 and 38 are snapped into place on the rail 50, they are held snugly against one another at line 12—12. The male wedge 38 and the female wedge 28 cannot be removed from the rail 50 (FIG. 7) without cutting the protruding tip 40.

Once the transmitter tag has been assembled, as above-described, with the strap rail assemblies 30 and 32 inserted into the receiving channels 31 and 33, and with the locking wedges 38 and 28 inserted and locked onto the rail 50, a locked transmitter tag unit is realized. The assembled unit provides a small, thin, smooth, closed device that can be comfortably and safely worn by its wearer.

Referring again to FIG. 7, located within the receiving channels 31 and 33 are strap terminals 214 and 215. (Only the strap terminal 215 is visible within the receiving channel 33 in FIG. 7, but it is to be understand that the strap terminal 214 is located within the receiving channel 31.) It is the purpose of these strap terminals 214 and 215 to electrically contact strap buttons 210 and 211 located in the strap rail assemblies 30 and 32, respectively. These strap buttons 214 and 215 are, in turn, in electrical contact with the strap 203 as explained below in reference to FIG. 9. Thus, the tamper detection circuits are maintained in electrical contact with the strap 203 by way of the strap terminals 214 and 215 and the buttons 210 and 211. The strap terminal 214 and the button 210 form a first electrode, and the strap terminal 215 and the strap button 211 form a second electrode. The first and second electrodes form an important part of the invention as they allow galvanic action to occur when they are made or coated with dissimilar metals, as explained more fully below.

Figure 9:
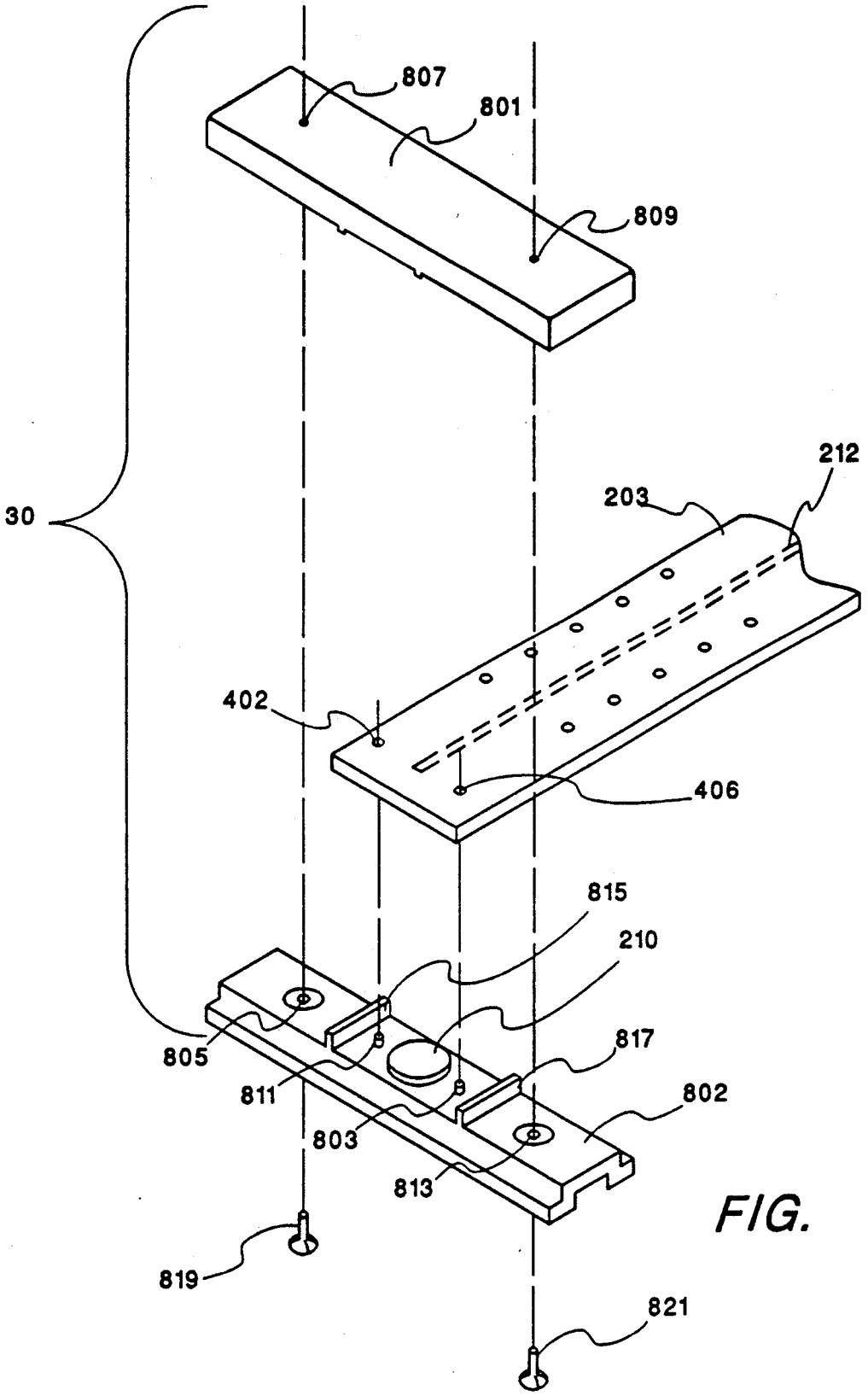
FIG. 9 is an exploded perspective view of a rail assembly that is secured to one end of the strap, which rail assembly allows the strap to be detachably secured to the transmitter tag.

Referring next to FIG. 9, an exploded perspective view of the rail assembly 30 attached to one end of the strap 203 is shown. (The rail assembly 32 is substantially the same as the rail assembly 30.) The rail assembly 30 includes a rail plate 802 and a clamp plate 801. The rail plate 802 has a first mounting hole 805 and a second mounting hole 813. A first mounting screw 819 is passed through the first mounting hole 805 and into a first threaded hole 807 of the clamp plate 801. Similarly, a second mounting screw 821 is passed though a second mounting hole 813 of the rail plate 802 and into a second threaded hole 809 of the clamp plate 801.

During assembly of the rail assembly 30, which may advantageously occur in the field after the strap 203 has been cut to the proper length, the strap 203 is placed between guide ribs 815 and 811 of the rail plate 801 so that mounting pins 811 and 803 pass through strap holes 402 and 406. Similar pairs of holes occur along the length of the strap 203 so that such holes may always be used regardless of the length to which the strap has been cut. The clamp plate 801 is then placed against the rail plate 802 so that the strap 203 is sandwiched between the clamp plate 801 and the rail plate 802. The screws 819 and 821 are then tightened a specified amount, thereby clamping and compressing the strap 203 between the rail plate 802 and clamp plate 801.

In addition to the mounting pins 811 and 803, the inner strap button 210 is also pressed against the strap 203 as the rail plate 802 is tightened against the clamp plate 801. The button 210 slightly deforms the strap 203, causing a button detent to appear in the strap 203 at the location of the button 210. (The clamp plate 801 has a recess aligned with the button 210 that facilitates formation of such button detent within the strap 203.)

Still referring to FIG. 9, the button 210 is made from an electrically conductive metal, e.g., brass, and is in electrical communication with the surface of the strap 203 when the strap 203 is compressed by the clamp plate 801 against the rail plate 802. A backside of the button 210 also makes electrical contact with the strap terminal 214 when the rail assembly 30 is slid into the channel 31 as explained previously. At the other end of the strap (not shown in FIG. 9) a substantially similar rail assembly 32 includes another rail plate and clamp plate that are secured to the strap 203 in the same manner similar as that described above relative to the rail assembly 30.

When the two rail assemblies 30 and 32 are slid into the channels 31 and 33 (FIG. 7), and assuming that the strap 203 is made from an electrically conductive material, an electric current path is formed between the strap terminal 214 and the strap terminal 215 through the strap 203.

In order to better control the resistance (impedance) of the strap 203, a conductor 212 having a low resistance is imbedded or laminated within the material from which the strap 203 is made. A cross-sectional view of one embodiment of the strap 203 used with the present invention is shown in FIG. 10A. The strap is made from an electrically conductive polymer 401, e.g., Santoprene 199-87 available from Advanced Elastomer Systems L. P. of St. Louis, Mo. Such electrically conductive polymer has a conductivity of approximately 90~200 ohm·cm. A substantially axial metal conductor 212 is imbedded or laminated within the conductive polymer 401. In order to increase the strength of the strap and to simplify the implantation of the metal conductor 212, the conductor 212 is mounted on one side of a reenforcing insert 403. The insert 403, with the conductor 212 attached thereto, are then imbedded or laminated into the polymer 401 in conventional manner.

The metal conductor 212 is preferably made from a multifillar copper braid available as part no. NE16-2-40T from Cooner Wire of Chattsworth, Calif. However, for purposes of the present invention, any unifilar or multifillar conductive metal could by utilized. The insert is preferably made from Polychem HC-1250S available from Polychem Corp. of Mentor, Ohio. Processes for forming such polymer straps and for implanting such reinforcing inserts therein are known in the art of polymer manufacturing.

Referring next to FIG. 10B, a cross sectional view of the strap 203 as sandwiched between the rail plate 802 and the clamp plate 801 is shown. As seen in FIG. 10B, the strap button 210 is compressed against the strap 203 such that a prescribed distance d exists between a tip of the strap button 210 and the conductor 212 imbedded within the strap 203. Because the strap material 401 is conductive, albeit having a relatively low conductivity (high resistance), this distance d provides a resistance having a value that is more or less known. (Such resistance provided by the distance d corresponds to the resistors $R_5$ or $R_6$ shown schematically in FIG. 4.) Typically, the distance d is on the order 1.02 mm (0.040 inches). For the preferred type of conductive material used, described above, the resistance corresponding to the distance d is on the order of 40–60 ohms. Although this does not provide a precision resistance value, it is sufficiently well defined for purposes of the present invention. Thus, the total strap resistance, as measured from the strap button 210 to the strap button 211, is on the order of 80–120 ohms.

It is noted that the entire strap 203 need not be conductive for purposes of the present invention. All that is required is that the end regions of the strap 203—more precisely the regions of the strap that include the strap material in the distance d between the conductor 212 and the strap button 210—be impregnated with conductive material, or otherwise made conductive. However, for ease of manufacture and construction, it is generally preferred that the entire strap 203 be made from a uniformly consistent conductive material.

Figure 11:
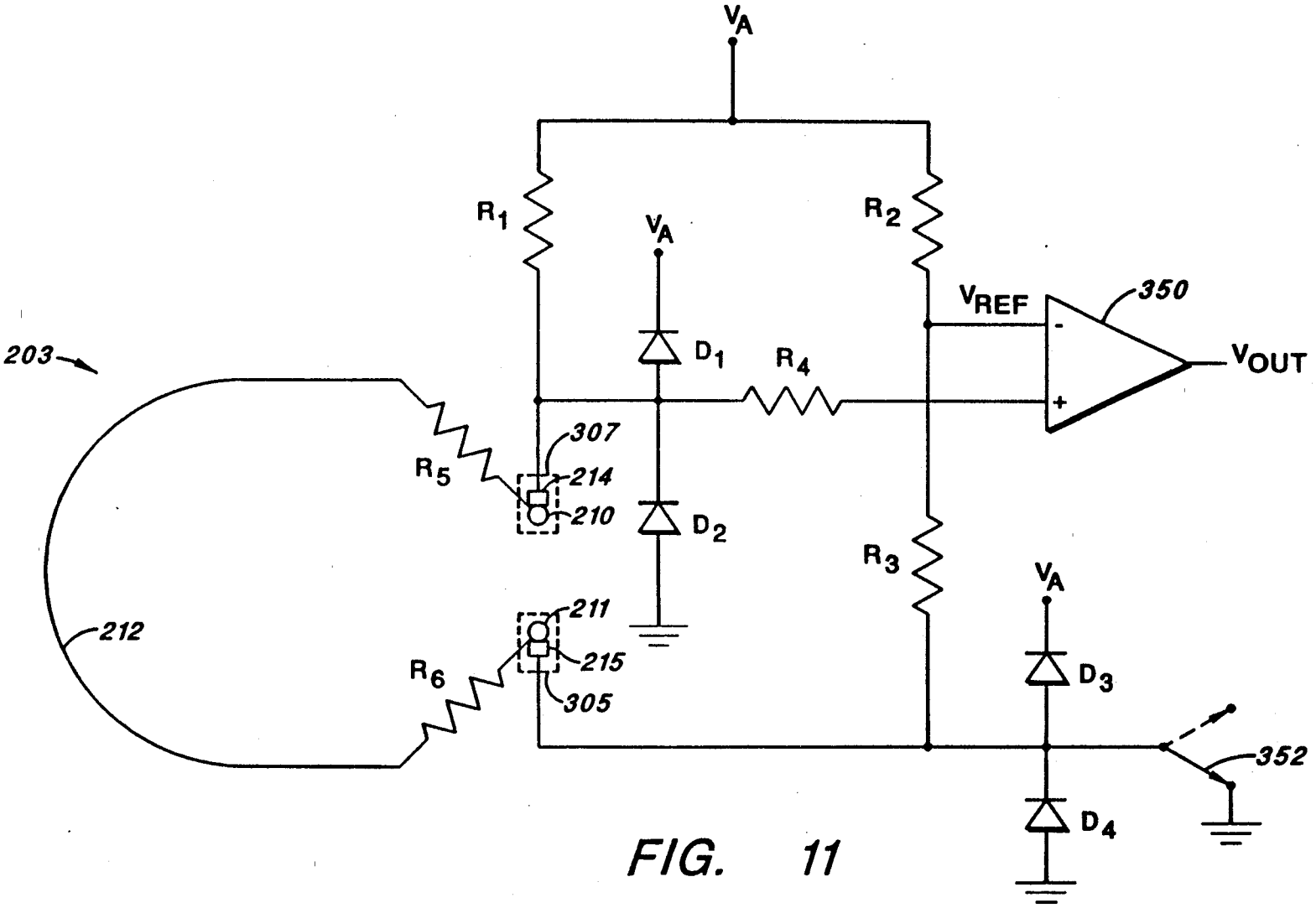
FIG. 11 is a schematic diagram of one embodiment of a tamper detection circuit made in accordance with the present invention.

Referring now to FIG. 11, a schematic diagram of one embodiment of the tamper detection circuit of the present invention is shown. Included in FIG. 11, is a schematic representation of the strap 203. One end of the conductor 212 imbedded within the strap 203 is in electrical communication through the resistor $R_5$ with a first electrode 307, comprising the strap button 210 and the tag terminal 214. The other end of the conductor 212 is in electrical communication through the resistor $R_6$ with a second electrode 305, comprising the strap button 211 and the tag terminal 215. The electrodes 307 and 305 are coupled to an operational amplifier/comparitor 350, which may be realized using a TLC3702 commercially available from Texas Instruments, that compares the electric potential developed across the strap 203, i.e, developed across the terminals 307 and 305, with a reference voltage $V_{REF}$. The reference voltage $V_{REF}$ is generated as described previously in connection with FIG. 4.

In accordance with the present invention, the electrode 307 includes a relatively cathodic metal, e.g., gold plated brass, and the electrode 305 includes a relatively anodic metal, e.g., 60/40 Pb-Sn solder plated, or tinned, onto the tag terminal 214 and the strap button 210.

When the electrodes 307 and 305 are submerged in an electrolyte, e.g., saltwater, and with the electrodes 307 and 305 being made from or coated with dissimilar metals, the anode 305 undergoes an anode reaction and the cathode 307 undergoes a cathode reaction. These reactions cause a galvanic voltage to be developed across the electrodes, similar to the development of a voltage in a battery cell, with negative charge carriers flowing to the anode 305, and positive charge carriers (ions) flowing to the cathode 307. The return path for the flow of charged particles is through the strap, i.e. , through the resistors $R_5$ and $R_6$, and the conductor 212. That is, the negative charges (electrons) return to the cathode 307 from the anode 305 via the current path through the strap. In the event that the conductor 212 is severed, the negative charges are no longer able to return to the cathode 307 via the current path of which the conductor 212 is a part. Thus, excess negative charge builds up on the anode electrode 305 and excess positive charge builds up on the cathode electrode 307. These excess charges cause a change in the voltage, e.g., an increase, between the first and second electrodes 307 and 305. This change in voltage is detected by the amplifier/comparitor 350.

Advantageously, the conductor 212 is positioned substantially axially within the strap 203. Thus, even though the strap 203 is exposed to the wearer of the tag, the conductor 212 is not readily accessible to the wearer. Therefore, it is highly unlikely that the wearer of the tag would be able to: (1) sever the strap 203 without severing the conductor 212; (2) locate the conductor 212 within the strap 203 for the purpose of attaching a jumper thereto without severing the conductor 212; or (3) create a parallel electric current path to the conductor 212 before severing the strap 203 and/or the conductor 212.

The circuitry shown in FIG. 11 may also be used to detect an increase in the resistance of the strap, as explained previously in conjunction with FIGS. 4 and 5. A fixed voltage is applied across the first and second electrodes 307 and 305. As long as current flows through the current path (the strap), the voltage remains fixed because a fixed voltage drop will occur in resistors $R_5$ and $R_6$ in response to the current f low. However, in the event that the strap 203, and thus the conductor 212, is severed or cut, the current flow will stop. The stopped current flow causes a change in the voltage across the electrodes 307 and 305, which is detectable by the amplifier/comparitor 350.

Thus, in the event the strap is severed, the circuitry shown in FIG. 11 detects the increased impedance of the current path. If the wearer tries to foil the tamper detector by immersing the tag in an electrolyte before severing the tag, the amplifier/comparitor 350 detects the resulting galvanic action, i.e., the changed voltage that develops across the electrodes 307 and 305 resulting from galvanic action between the dissimilar metal electrodes.

As seen in configuration of the tamper circuit shown in FIG. 11, the conductor 212 is connected in series with the resistors $R_5$ and $R_6$. In addition, the operational amplifier/comparitor 350 has an inverting input that is coupled to a first voltage divider comprised of resistors $R_2$ and $R_3$, and a non-inverting input is coupled to a second voltage divider comprised of resistor $R_1$ and the current path through the strap: resistors $R_5$ and $R_6$, and the conductor 212. Normally, the voltage on the non-inverting input of the operational amplifier/comparitor 350 is lower than the voltage on the inverting input of the operational amplifier/comparitor 350, e.g., 30 mV at the non-inverting input verses 80 MV at the inverting input. Therefore, the voltage out of the operational amplifier/comparitor 350, $V_{OUT}$, is a low voltage, e.g., approximately zero volts. If the conductor 212 is severed, the voltage across the electrodes 307 and 305 increases as a result of the stopped current flow, or as a result of the galvanic action. As soon as the voltage across the electrodes exceeds the reference voltage generated by the resistive divider network made up of resistors $R_2$ and $R_3$, the output voltage of the operational amplifier/comparitor 350 switches to a high voltage, e.g. 3.5 volts. The output voltage of the operational amplifier/comparitor 350 thus serves as a tamper signal that can be used to activate other electronic circuitry within the tag case. Such other electronic circuity typically includes the setting of one or more bits in the identification signal that is generated by the transmitter tag 201. See, e.g., U.S. Pat. No. 4,885,571 previously incorporated by reference.

Advantageously, a switch 352 is provided as part of the tamper detection circuitry that can be used to selectively disable the tamper circuit. When the switch is in an "ON" position, it couples the voltage dividers to ground (the position shown as a solid line in FIG. 11), thereby allowing current to flow through the voltage dividers as designed. When the switch is in an "OFF" position, it decouples the voltage dividers from ground (the position shown as a dashed line in FIG. 11), and no current flow occurs. In this way, the tamper circuit may be turned OFF when not needed, thereby providing a significant power savings and prolonging the life of the battery 220 (FIG. 4). Typically, the tamper circuit of FIG. 11 need only be turned ON on a sampled basis, e.g., once every 0.5 seconds.

Also shown in FIG. 11 are diodes $D_1$, $D_2$, $D_3$ and $D_4$. These diodes are oriented so that current does not normally flow through them. $D_1$ is coupled to the first voltage divider at the non-inverting input of the operational amplifier/comparitor 350 and coupled to the supply voltage $V_A$. $D_2$ is coupled to the first voltage divider at the non-inverting input of the operational amplifier/comparitor 350, and coupled to ground. $D_3$ is coupled to the switch at the side of the voltage dividers and to the supply voltage $V_A$. $D_4$ is coupled to the switch at the switchable side of the voltage dividers and to ground. So configured, these diodes advantageously reduce the chance of electrostatic discharge adversely affecting the detectors.

It is thus seen that the present invention provides a tamper circuit for use with an EHAM or similar system that detects a change in the resistance of a strap used to secure a transmitter tag to an offender, regardless of whether the tag and strap are immersed in an electrolyte solution, thereby providing a means of detecting any attempts to remove the tag by tampering with the strap.

It is further seen that the invention provides a transmitter tag assembly for use with an EHAM or similar system that allows tamper events to be readily detected, yet is simple to manufacture, and easy to install and attach to an offender.

Moreover, it is seen that the invention provides a tamper circuit for use with an EHAM or similar system that facilitates a plurality of tamper events to be monitored, and that reports a tamper condition only when a prescribed one or combination of such monitored tamper events occurs.

While the invention herein disclosed has been described by means of specific embodiments and applications thereof, numerous modifications and variations could be made thereto by those skilled in the art without departing from the scope of the invention set forth in the claims.

What is claimed is:

1. An apparatus for detecting a violation comprising: a wearable tag;

a coupling means for connecting a strap to said wearable tag;

said strap having an integrated conductor integrated into said strap;

a closing means for closing said strap around a part of a wearer of said wearable tag;

a tamper means, including:

a first electrode coupled to a first part of said integrated conductor, the first electrode including a cathodic metal;

a second electrode coupled to a second part of said integrated conductor, the second electrode including a anodic metal; and an electric potential detector coupled to said first and second electrodes, the electric potential detector being able to detect a change in the electric potential between said first and second electrodes.

2. The apparatus of claim 1 wherein said tamper means further includes sensing means for sensing when said wearable tag is held near the flesh of said wearer.

3. The apparatus of claim 2 wherein said sensing means comprises means for sensing a change in the capacitance between two spaced-apart electrodes.

4. The apparatus of claim 1 wherein said tag includes a housing having electronic circuitry enclosed therein, said electronic circuitry including means for transmitting a signal to a location remote from said tag.

5. The apparatus of claim 4 wherein said signal includes a tamper signal indicative of a violation of at least one of a group of violatable components, said group of violatable components consisting of said wearable tag, said strap, said coupling means and said closing means.

6. The apparatus of claim 5 wherein said signal further includes an encoded signal, said encoded signal including identification information.

7. The apparatus of claim 1 wherein said electric potential detector comprises a comparator.

8. An apparatus for detecting a violation comprising:

a wearable tag:

a coupling means for connecting a strap to said wearable tag;

said strap having a conductor imbedded therein;

said imbedded conductor not being readily accessible to a wearer of said wearable tag;

a closing means for closing said strap around a part of said wearer of said wearable tag;

a tamper means, including:

a first electrode coupled to a first part of said imbedded conductor via a first conductive region of said strap;

a second electrode coupled to a second part of said imbedded conductor; and an impedance detection means for detecting a change in the impedance between said first and second electrodes.

9. The apparatus of claim 8 wherein said second electrode is coupled to said second part of said imbedded conductor via a second conductive region of said strap.

10. The apparatus of claim 9 wherein said imbedded conductor comprises a metal wire imbedded axially within said strap; and said first conductive region and said second conductive region include a conductive polymer.

11. The apparatus of claim 10 wherein said metal wire comprises a multifillar wire having at least three strands.

12. The apparatus of claim 8 wherein said second electrode is coupled to said imbedded conductor via a direct connection.

13. The apparatus of claim 8 wherein said tamper means further includes sensing means for sensing when said wearable tag is held near the flesh of said wearer.

14. The apparatus of claim 13 wherein said sensing means comprises means for sensing a change in the capacitance between two spaced-apart electrodes.

15. The apparatus of claim 8 wherein said tag includes a housing having electronic circuitry enclosed therein, said electronic circuitry including means for transmitting a signal to a location remote from said tag.

16. The apparatus of claim 15 wherein said signal includes a tamper signal indicative of a violation of at least one of a group of violatable components, said group of violatable components including said wearable tag, said strap, said coupling means and said closing means.

17. The apparatus of claim 16 wherein said signal further includes an encoded signal, said encoded signal including identification information.

18. The apparatus of claim 8 wherein said impedance detection means comprises a comparator.

19. A method for detecting a tamper event associated with the use of a transmitter tag that is secured to a limb of a person or object being monitored, said method comprising:

(a) forming a strap, the strap having a first electrically conductive region, the first electrically conductive region including a first electrically conductive material;

(b) integrating a conductor into said strap, a first end of the conductor being in electrical communication with the first electrically conductive region, the conductor including a second electrically conductive material having a resistance that is less than the resistance of the first electrically conductive region;

(c) positioning a first electrode at said first electrically conductive region, thereby putting the first electrode in electrical communication with said first end of the conductor;

(d) positioning a second electrode at a communication point, said communication point being in electrical communication with a second end of the conductor; and (e) monitoring the impedance between said first electrode and said communication point, a significant change in said impedance providing an indication that a tamper event has occurred.

20. The method of claim 19 wherein said communication point includes a second electrically conductive region of the strap, the second electrically conductive region of the strap including a third electrically conductive material.

21. The method of claim 19 wherein said communication point includes the second end of said conductor.

22. An apparatus for detecting a violation comprising:

a wearable tag;

a coupling means for connecting a strap to said wearable tag;

said strap having an integrated conductor integrated into said strap;

said integrated conductor not being readily accessible to a wearer of said wearable tag;

a closing means for closing said strap around part of said wearer of said wearable tag;

a first tamper means, including:

a first electrode coupled to a first part of said integrated conductor, the first electrode including an anodic metal;

a second electrode coupled to a second part of said integrated conductor, the second electrode including a cathodic metal; and an electric potential detector coupled to said first and second electrodes, the electric potential detector being able to detect a change in an electric potential between said first and second electrodes;

a second tamper means, including:

a first conductive region of said strap, the first conductive region being in electrical communication with a first part of said integrated conductor;

a second conductive region of said strap, the second conductive region being in electrical communication with a second part of said integrated conductor;

said first electrode being coupled to said first conductive region;

said second electrode being coupled to said second conductive region; and an impedance detection means for detecting a change in the impedance between said first and second electrodes; and a third tamper means, including:

a sensing means for sensing when said wearable tag is held near the flesh of said wearer; and said sensing means comprises means for sensing a change in the capacitance between two spaced-apart electrodes.

23. A tamper circuit for detecting an attempt to remove a wearable transmitter tag of the type used within an electronic house arrest monitoring (EHAM) system comprising:

a conductive strap made from a conductive material that is detachably secured at each end to respective terminals on opposite sides of said transmitter tag;

amplifier means within said transmitter tag for monitoring the impedance of said conductive strap, whereby any attempt to cut said strap is detectable by said amplifier;

said respective terminals including dissimilar metals, whereby galvanic action occurs between said respective terminals when said terminals are immersed in an electrolyte solution, which galvanic action is detectable by said amplifier means.

24. The tamper circuit as set forth in claim 23 further including an approximately known resistance inserted between the respective ends of said conductive strap and said respective terminals.

25. The tamper circuit as set forth in claim 24 further including a conductor imbedded within said conductive strap, said conductor having a resistance that is much less than the resistance of the conductive material of said conductive strap, said conductor being in electrical contact with said respective terminals through the conductive material of said conductive strap.

* * * * *